United States Patent [19]

Yamashita et al.

[11] Patent Number: 4,966,301

[45] Date of Patent: Oct. 30, 1990

[54] CONTAINER WITH AN EASY OPEN TYPE CLOSURE

[75] Inventors: Yuji Yamashita; Koji Kobayashi, both of Iwatsuki; Keisuke Shimizu, Houya; Koji Maekawa, Kawagoe, all of Japan

[73] Assignee: Hokkai Can Co., Ltd., Tokyo, Japan

[21] Appl. No.: 876,402

[22] Filed: Jun. 20, 1986

[30] Foreign Application Priority Data

Jun. 20, 1985 [JP] Japan ..... 60-133067

[51] Int. Cl.[5] ..... B65D 17/34

[52] U.S. Cl. ..... 220/270

[58] Field of Search ..... 220/270, 276, 258

[56] References Cited

U.S. PATENT DOCUMENTS 3,990,603 11/1976 Brochman ..... 220/270 X 4,403,710 9/1983 Hirota et al. ..... 220/270

4,548,333 10/1985 Kobayashi et al. ..... 220/270 X 4,572,393 2/1986 Kobayashi et al. ..... 220/270

FOREIGN PATENT DOCUMENTS 932252 11/1959 United Kingdom .

1252328 4/1969 United Kingdom .

1428536 7/1973 United Kingdom .

2104864 6/1982 United Kingdom .

2151579 11/1984 United Kingdom .

*Primary Examiner*—Steven M. Pollard

[57] ABSTRACT

A container having an easy open type closure having a pull tab opening member which is adhesively fixed to the top surface of the closure of the container. The adhesive member is made of a resinous member comprising a copolymer of $\alpha$, $\beta$ unsaturated carboxylic acid or ionomer resin containing a phenol series antioxidant.

28 Claims, 3 Drawing Sheets

CONTAINER WITH AN EASY OPEN TYPE CLOSURE

BACKGROUND AND SUMMARY OF THE INVENTION

The present invention relates to a container with an easy open-type closure of such a type that the container is tightly closed at its opening end portion with a metallic foil sheet made closure. A strip shaped pull opening member, having at its one end a pulling tab, is fixed more firmly to the top surface of the closure than a tearing strength of the closure so that by lifting the pulling tab of the pull-opening member in relation to the closure, the closure may be torn open into a predetermined opening shape.

As for a container of this kind, there has been heretofore known a container such as that disclosed in Japanese Kokai Utility Model Application Publication Sho No. 54-97342, for instance, which shows a metallic foil sheet made closure tightly fixed to the opening end portion of the container barrel, with a pull-opening member firmly fixed to the closure. By pulling the pull-opening member, the closure may be opened by tearing.

This type of container, however, is defective in that although the closure is so arranged as to be torn open along the shape of the pull-opening member itself, it actually happens that the closure cannot be broken open definitely or neatly along a predetermined opening shape.

For making the container a more practicable one in which a closure can be torn open by a pull-opening member in a predetermined opening shape, it is necessary to satisfy the following three prerequisite points.

(1) It is necessary that, besides the pull-opening member, an opening edge for regulating an initial tear opening position is predetermined so that when the pull-opening member is pulled, the metallic foil sheet is applied with a reliable initial tearing, and then the tearing is advanced towards the predetermined opening edge, and thereafter the tearing is carried out definitely and neatly along its opening edge.

(2) It is necessary that the pull-opening member is firmly adhered to the metallic foil sheet, and the adhesive strength thereof maintains a level above the tearing strength of the metallic foil sheet, even after a lapse of time.

(3) It is necessary that the pull-opening member itself has a sufficient tensile strength to prevent it from being fractured when the metallic foil sheet is initially broken open and also that the tensile strength is maintained even after a lapse of time.

The inventors have made various investigations and research for obtaining a container wherein a metallic foil sheet made closure is fixed, together with a ring-shaped member, to an opening end portion of a container barrel, and a pull-opening member is fixed to the closure through an adhesive agent layer so that, by pulling upward on the pull-opening member, the closure may be torn open in a definite and neat manner to obtain a predetermined opening shape defined by the ring-shaped member.

As a result thereof, and with respect to prerequisite point (1) above, such a container has been developed and proposed by Japanese Kokai Utility Model Application Publication Sho No. 57-177932, wherein the closure of the container can be torn open in a definite and neat manner along a predetermined opening shape defined by the opening edge by forming the pull-opening member into a strip-shape which has at its one end a pulling tab and has a guide edge directed towards the opening edge of the ring-shaped member, and in addition extends to turn along at least half a circle of the opening edge.

Additionally, such an improvement wherein the pull-opening member is provided near the pulling tab with a notch or the like so as to create a weakened part for improving the initial opening property, and such an improvement wherein the pull-opening member is formed into a swirl shape for improving the tear opening property along a predetermined shape have been proposed by Japanese Kokai Utility Model Application Publications Sho No. 58-185526 and Sho No. 59-32666.

One of these proposed containers is shown in FIGS. 8 and 9. Namely, a closure shown in FIGS. 8 and 9 is made of a composite sheet comprising a metallic foil sheet such as an aluminum foil laminated with thermoplastic synthetic resin.

The closure covers an opening portion of a container barrel c and is fixed air-tight, by seaming or by fusion adhesion, to an opening end portion of the container barrel c through a ring shaped member b made of metal or plastic. A pull-opening member f in a strip-shape is made of a thermoplastic resin or the like, and is formed into an annular shape having at its one end a pulling tab e. The opening member f is more firmly fixed, by fusion adhesion or through an adhesive agent, to a region at the top surface of the closure that is defined within an opening edge d of the ring-shaped member b, than the tearing strength of the closure a.

If, in order to open the closure a, the pulling tab e is held and pulled upwards by fingers in relation to the closure a, an initial tearing for opening is brought about at a starting end g of a fixing portion between the pull-opening member f and the closure a.

If, after this initial tearing, the pull tab e is further lifted, a tear extending along an outside guide edge h provided on the pull-opening member f reaches the opening edge d of the ring-shaped member b, and a tear extending along an inside edge i of the pull-opening member f from a point x which is a starting point is produced in the closure a.

If the pulling tab e is further lifted, the tear which has reached the opening edge d is advanced along the opening edge d, and the tear which has extended along the inside edge i is advanced to nearly half a circle. As a result thereof, the closure a is loosened or slackened at the center region thereof, so that the advancing of the tearing along the inside edge i cannot be continued. Accordingly, the subsequent tearing stress is concentrated only on the portion extending along the opening edge d. As a result, the tearing advancing along the opening edge d is continued to the end, so that a complete tear-opening of the closure can be performed.

In addition, it frequently happens that this kind of container is usually kept for a long time in a comparatively high temperature environment in the summer. Even after the container is kept for a long time in such a high temperature environment, the removal of the pull-opening member from the metallic foil sheet must be avoided. In this respect, it is necessary that the initial strong adhesive strength therebetween be maintained for a long period of time in such a high temperature condition as mentioned above.

As for an adhesive agent which can be used for adhering to a metallic material such as a metallic foil sheet or the like, various investigations and searches have been heretofore made, and there has been proposed polyolefins, olefin copolymers, derivatives thereof and those containing a cross-linking agent. However, the former is so low in adhesive strength in relation to the metallic material that it is not suitable for practical use.

The latter requires a cross-linking treatment after being applied to the metallic material, so that the same cannot be suitably used for the container of the present invention.

On the other hand, it is known that an adhesive agent using a copolymer of an olefin—$\alpha,\beta$ unsaturated carboxylic acid or ionomer resin, having carboxyl groups on its side chain can be firmly adhered by fusion adhesion to a metallic material. This adhesive has excellent moldability, and is tough and has good elasticity, and is also excellent in its wear resisting property and low temperature property. It also meets the U.S. FDA Standard and the Japanese Public Welfare Notification No. 20 (Feb. 16, 1982) so that it is suitable for use as an adhesive agent for a container for packing foodstuff.

However, according to the inventors' study, it has been found that a container with such an easy open type closure such that a pull-opening member f is adhered to a metallic foil sheet, as shown in FIGS. 8 and 9, by an adhesive agent using such a synthetic resin material as described above is so defective that after the container is kept in a high temperature environment such as the summer, if the pull-opening member f thereof is pulled upwards so that the metallic foil sheet may be broken open along the opening edge d of the ring-shaped member b, the tear advancing along the inside edge i goes underneath the pull-opening member f, before reaching as far as half a circle, so that the loosening of the closure becomes insufficient and consequently the tearing stress advancing along the opening edge d is dispersed, and as a result the tearing of the closure member a is made at an immediate region between the opening edge d and the pull-opening member f, and a piece of the closure member a remains unremoved at such a portion near the opening edge d that is near about 180 turning degrees from the initial tear opening portion as shown by imaginary lines in FIG. 8.

Additionally, it has been found that, if the container is kept for a long period of time, it frequently happens that the pull-opening member f pulls off from the closure member a in the beginning of the tearing operation.

As a result of the inventors' investigations about the cause thereof, it has been found that the main cause of the decrease in adhesive strength resulted from degradation, with a lapse of time, of the adhesive agent disposed between the closure a and the pull-opening member f. In addition, it has been ascertained that the decrease in the adhesive strength thereof with the lapse of time is fundamentally based on the fact that, while keeping and storing the container, the oxygen in the atmosphere invades and diffuses into the adhesive agent, so that the main chain of the copolymer resin is oxidized and becomes degraded.

Thus, in order to strongly adhere the metallic foil sheet and the pull-opening member f together, it is necessary to heat and melt the adhesive agent for a few seconds, several tens of seconds at a high temperature of about 160°-230° C., which is much higher than the melting point (70°-120° C.) of the adhesive agent. As a result, oxidation of the adhesive agent progresses beyond an induction period thereof, or in other words the time period of induction period to the point where degradation by oxidation takes place, that is, the period of time for keeping the container without degradation, after the foregoing fusion adhesion, is greatly shortened. Accordingly, even though the adhesive agent has a large adhesive strength immediately after the fusion of the adhesion, when kept at room temperature, the degradation thereof gradually progresses, resulting in a lowering in the adhesive strength thereof. This lowering in adhesive strength is especially remarkable at above 50° C., and if the adhesive agent is used for adhering the pull-opening member f to the closure member a, there arises the problem of loss of use after a lapse of time of only about 2-3 weeks. This is based on the fact that the strip-shaped pull-opening member f is formed in a comparatively narrow strip shape, and therefore oxygen invades and diffuses into the adhesive agent layer from both sides thereof. The degradation is produced at the region of the adhesive agent layer which is located underneath and along the strip-shaped pull-opening member f.

Also, when considering the affinity between the pull-opening member f and the adhesive layer, it is preferable that the pull-opening member f and the adhesive layer are made of the same resins of the same quality. In this case, however, as a result of the foregoing degradation, with the lapse of time of this resin, there is the fear that the pull-opening member f itself will fracture or break off at the time of the tearing of the metallic foil sheet. Accordingly, in such a case where the pull-opening member f is made of a synthetic resin which is equal in quality to that of the adhesive layer, any measure for preventing the degradation, with a lapse of time, of the pull-opening member is necessary.

An object of the present invention is to provide a container with an easy open type closure wherein the foregoing inconveniences are eliminated, and an opening operation by tearing a metallic foil sheet made closure by means of a pull-opening member is carried out easily and reliably, and the entire area of the closure can be opened easily and reliably and definitely by causing the tearing to advance along an opening edge of a ring-shaped member in succession after an initial tearing.

Another object of the present invention is to provide a container with an easy open type closure, wherein a pull-opening member, adhered to a metallic foil sheet made closure for serving as container opening means is such that, even after the container is kept for a long period in a high temperature environment, when the pull-opening member is pulled upwards for opening the closure, there does not remain any piece of the closure portion along an opening edge of a ring-shaped member.

Another object of the present invention is to provide a container with an easy open type closure, wherein a pull-opening member is firmly fixed, through an adhesive agent layer, to a metallic foil sheet made closure, and even if the container is kept for a long time in a high temperature environment, the adhesive agent layer is not reduced in it adhesive ability.

Another object of the present invention is to provide a container with an easy open type closure, wherein a pull-opening member is made of a resin material which is not reduced in its tensile strength, even after the container is kept for a long time in a high temperature environment. Also, the pull-opening member is firmly fixed to a metallic foil sheet made closure through an adhesive agent layer which is not reduced in its adhesive strength with a lapse of time.

According to another aspect of the present invention, a specific adhesive layer is provided for a container with an easy open type closure of such an arrangement that a metallic foil sheet made closure is fixed provided together with a ring-shaped member on an opening end portion of a container barrel. Also a strip-shaped pull-opening member which has at its one end a pulling tab, and has an outside guide edge thereof directed towards an opening edge of the foregoing ring-shaped member, extends as long as at least one-half a circle of the opening edge of the ring-shaped member. The strip-shaped member is more firmly fixed to the top surface of the closure through the adhesive layer than the tearing strength of the closure. Advantageously, the adhesive agent layer is made of a resinous compound which is a copolymer of an olefin with an $\alpha,\beta$ unsaturated carboxylic acid or ionomer resin which contains 0.01–0.5% by weight of a phenol series antioxidant.

According to another aspect of the present invention, a container with an easy open type closure is provided wherein a metallic foil sheet made closure is fixedly provided, together with a ring-shaped member, on an opening end portion of a container barrel. A strip-shaped pull-opening member has at its one end a pulling tab, and has an outside guide edge thereof directed towards an opening edge of the foregoing ring-shaped member, and extends at least one-half of a circle around the opening edge of the ring-shaped member. The strip-shaped pull opening member is fixed to the top surface of the closure utilizing an adhesive layer which provides a tearing strength which is greater than the tearing strength of the closure. The adhesive layer and the pull-opening member are respectively made of a copolymer resin of an olefin $\alpha,\beta$ unsaturated carboxylic acid or ionomer resin, and the resin of the pull-opening member contains 0.01–0.5% by weight of a phenol series antioxidant and the pull-opening member and the adhesive layer are adhered together by fusion.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE DRAWINGS

Figure 1:
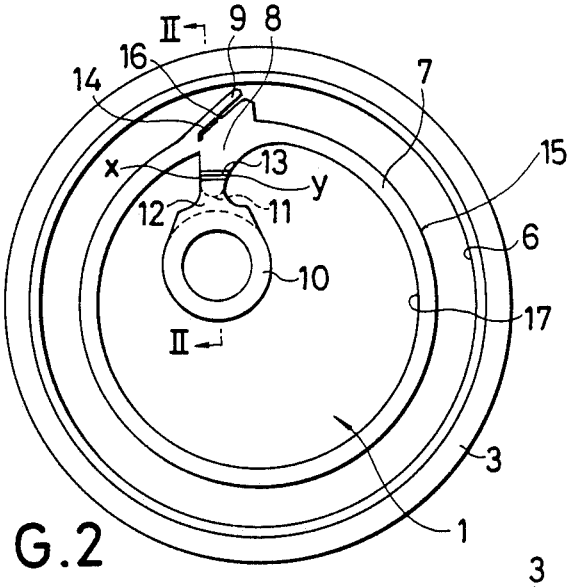
FIG. 1 is a top plan view of one embodiment of the present invention.
Figure 2:
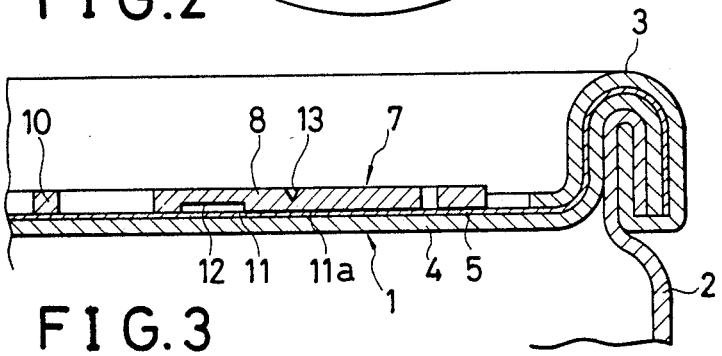
FIG. 2 is a sectional view taken along the line II—II of FIG. 1.

Referring to FIGS. 1–5 showing one example of the present invention, numeral 1 denotes a closure which is fixed, by seaming together with a ring-shaped member 3 to an opening end portion of a can barrel 2. In more detail, the closure 1 comprises an aluminum foil which is laminated on its upper surface with an adhesive layer 5 made of a synthetic resinous compound described hereinafter.

The closure 1 is applied to cover an opening surrounded by the ring-shaped member 3, which is made of a metallic plate such as a tin plate, a tin free steel, a thermoplastic resin plate, or the like, and which is similar in shape to a flange portion of a conventional can closure. The ring-shaped member 3 is adhered to the closure through the adhesive layer 5, which is attached to the rear surface of the member 3. The closure 1 is fixed by a double seaming to the can barrel 2 through the ring-shaped member 3. The closure 1 may be a single layer or multiple layers of aluminum foil. Instead of the above, the manner of fixing the closure 1 to the can barrel 2 may be carried out in such a way that the closure 1 is fixed to directly cover the opening of the can barrel 2. Thereafter the ring-shaped member 3 is put on the closure 1 and is attached to the open end portion of the can barrel 2.

Numeral 7 denotes a strip-shaped pull-opening member which is small in width and extends annularly around the can and has an initial end portion 8 and a final end portion 9 which are located in opposite spaced relationship from one another. The initial end portion 8 has a ring-shaped pulling tab 10 connected thereto. The pull-opening member 7 is adhered more firmly to a top surface of the closure 1 through fusion of the foregoing adhesive agent layer 5 than the tearing strength of the closure 1 so as to leave a proper interval from the opening edge 6 of the ring-shaped member 3. The fixing relationship between the pull-opening member 7 and the closure 1 is such that a position shown by broken lines in FIG. 1 is a starting end 11 of the fixing portion and the hole length of the remainder portion of the pull-opening member 7 is fixed to the closure 1. The pulling tab may be in a separated condition from the top surface of the closure 1 or may be so slightly adhered thereto as to be easily separable therefrom. The materials of the pull-opening member 7 must be larger in strength than the tearing strength and the tensile strength of the closure 1, and the fixing thereof to the closure 1 through the adhesive agent layer 5 must be larger in strength than the tearing strength of the closure 1.

Figure 3:
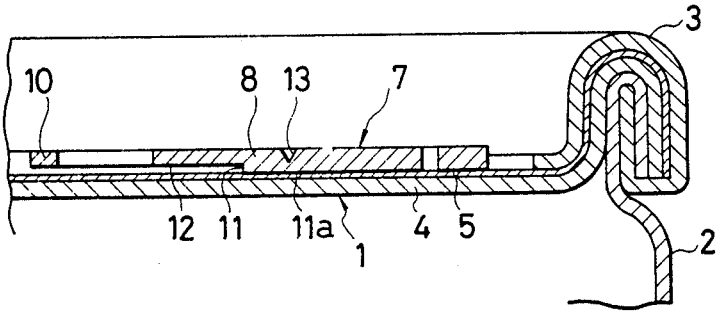
FIG. 3 is a sectional view similar to FIG. 2 for showing a modified embodiment thereof.

Numeral 12 denotes a thin connection between the pulling tab 10 and the starting end 11 of the part adhering between the pull open member 7 and the closure 1. The thin portion 12 is provided so that when the pulling tab 10 is raised and pulled upwards in a direction remote from the closure 1, it makes it easy to bend the pulling tab 10 in the upward direction. This thin portion 12 may be so provided that, as shown in FIG. 3, it may be level with the top surface of the pulling tab 10 and the top surface of the pull-opening member 7, and also the pulling tab 10 is as thin as the thin portion 12, so that a gap is formed between the lower surface of the total length of the thin portion 12 and the pulling tab 10, and the top surface of the closure 1.

Numeral 13 denotes a weakened portion formed by making a recess in the upper surface of the pull-opening member 7 near the initial end 11 of the pull-opening member 7, and, in the illustrated example, the weakened portion is formed into a V-shaped notch, so that the rigidity thereof is weaker than that of the pull-opening portion 7. Thus, such a portion adhering between the pull-opening member 7 and the closure 1 that is located between the weakened portion 13 and the starting end 11 may serve as an initial tearing portion when the closure 1 is broken open by means of the pull-opening member 7.

Numeral 14 denotes a guide edge directed towards the opening edge 6 of the ring-shaped member 3 that is so formed along the outside of the initial end portion 8 as to be opposite to a final end portion 9 of the pull-opening member 7. The guide edge 14 serves in such a manner that, when the closure 1 is broken open by tearing by means of the pull-opening member 7, it may guide the tearing of the closure 1 extending along the outside edge 15 of the pull-opening member 7 to advance towards the opening edge 6.

Numeral 16 denotes a connecting portion for providing an interconnection separably between the initial end portion 8 and the final end portion 9 of the pull-opening member 7.

The adhesive agent layer 5 for adhering the pull-opening member 7 to the closure 1 will be explained in detail as follows:

According to the present invention, for the adhesive agent layer 5, there is used a resinous compound comprising a copolymer of an olefin and an $\alpha,\beta$ unsaturated carboxylic acid resin or ionomer resin. Advantageously the copolymer contains a phenol series antioxidant in an amount of 0.01–0.5% by weight.

As for the copolymer, there may be mentioned, for instance, a copolymer resin prepared by using as the $\alpha$-olefin, such as ethylene, propylene, butene, and the like, and as the $\alpha,\beta$-unsaturated carboxylic acid such as acrylic acid, methacrylic acid, and the like.

Above all, the copolymer prepared by the copolymerization of ethylene and methacrylic acid, used as the essential component thereof, is especially preferable for the present invention because it is excellent in its initial adhesive property and toughness.

As for such copolymer resins, there can be used those identified under trade names "NUCREL 410", "NUCREL 403", "NUCREL 925", "NUCREL 010", "NUCREL 035" (by Mitsui DuPont Polychemcal).

In addition, as for the ionomers which can be used in the present invention, there can be mentioned, for instance, those prepared by neutralizing a part of the side chain carboxyl groups of the copolymer resin. Thus, copolymers prepared by the copolymerization of an $\alpha$-olefin with an $\alpha,\beta$ unsaturated carboxylic acid as the essential compounds are neutralized with a metal such as sodium, potassium, zinc, magnesium, calcium or the like.

It is preferable for the present invention to use an ionomer resin prepared in such a manner that part of the side chain carboxyl group of the ethylene-methacrylic acid copolymer resin prepared by using ethylene and methacrylic acid as the essential components is neutralized with zinc or sodium, because this material is especially excellent in its initial adhesive property and toughness.

As for such an ionomer resin, there may be used those sold under trade name "Surlyn 1555", "Surlyn 1560", "Surlyn 1601", "Surlyn 1605", "Surlyn 1707", "Surlyn 1650", "Surlyn 1652", "Surlyn AD-8102", "Surlyn 1706" (by DuPont), and those sold under the trade names "HI-MILAN 1555", "HI-MILAN 1601", "HI-MILAN 1605", "HI-MILAN 1650", "HI-MILAN 1652", "HI-MILAN 1702", "HI-MILAN 1705", "HI-MILAN 1855" (by Mitsui Du Pont Polychemical).

In addition, according to the present invention, any of the foregoing resins may be used by being mixed with polyolefins such as polyethylene, polypropylene or the like, or such olefin polymers which do not contain carboxyl groups, such as ethylene-vinyl acetate copolymer or the like.

The amount of the carboxyl groups of the copolymer resin or of the ionomer resin containing the carboxyl group is $0.4\times10^{-3}-3.6\times10^{-3}$ equivalent/gram, and is preferably $0.5\times10^{-3}-2.9\times10^{-3}$ equivalent/gram. If the amount of the carboxyl groups is less than $0.4\times10^{-3}$ equivalent/gram, the resin is lowered in its initial adhesive strength in relation to a metallic material.

If the amount of the carboxyl groups is greater than $3.6\times10^{-3}$ equivalent/gram, the resin is reduced in its film forming property and in its moisture proofing property, and also is lowered in its adhesive property to the metallic material and in its protective property in relation to the metallic material.

As for the ionomer resin, it is preferable that less than 70% of the side chain carboxyl groups present in the above range is neutralized with zinc, sodium or the like. If the neutralization is above 70%, the resin is lowered in its heat resisting property and its film forming property.

As for the antioxidant used in the present invention, it should be high in compatability in relation to the foregoing resins utilized in the present invention, and should be capable of exhibiting its antioxidant effect by the addition of only a small amount thereof. Advantageously, the antioxidant will not color the surface of the closure, will not dissolve in the contents of the container, is non-volatile, and does not produce a bad influence on the flavor of the food product in the container.

The antioxidants meeting these requirements fall within the phenol type. This class of antioxidants hardly color the resins, and are extremely low in toxicity, so that they are especially suitable for use in package containers for foodstuff.

This class of antioxidants is, for instance, sold under the trade name "IRGANOX" by Ciba-Geigy, and suitable examples include, for example, 1,6-hexanediol-bis[3-(3,5-di-t-butyl-4-hydroxyphenyl)propionate] ("Irganox 259"), 1,3,5-trimethyl-2,4,6-tris(3,5-di-t-butyl-4-hydroxybenzyl)benzene ("Irganox 1330"), 2,4-bis-(n-octylthio)-6-(4-hydroxy-3,5-di-t-butylanilino)-1,3,5-triazine ("Irganox 565"), 2,2'-thiodiethylenebis[3-(3,5-di-t-butyl-4-hydroxyphenyl)propionate] ("Irganox 1035"), 2,2-thiobis(4-methyl-6-t-butylphenol) ("Irganox 1081"), N,N'-hexamethylenebis(3,5-di-t-butyl-4hydroxy-hydrocinnamide) ("Irganox 1098"), 3,5-di-t-butyl-4-hydroxy-benzylphosphonate-diethylester ("1222"), or 1,1,3-tris(5-t-buytl-4-hydroxy-2-methylphenyl)-butane,1,3,5-tris-(3,5-di-t-buytl-4-hydroxybenzyl) -isocyanurate, etc. Further there may be used antioxidants authorized by the FDA in U.S.A., for instance, pentaerythritol-tetrakis[3-(3,5-di-t-butyl-4-hydroxyphenyl)-propionate] ("Irganox 1010"), triethylenglycol-bis[3-(3-t-butyl-5-methyl-4-hydroxyphenyl)propionate] ("Irganox 245"), octadecyl 3-(3,5-di-t-butyl-4-hydroxyphenyl)-propionate ("Irganox 1076"), 2-t-butyl-$\alpha$-(3-t-butyl-4-hydroxyphenyl)-P-cumenylbis(P-nonylphenyl)-phosphite, 2-(3'-t -butyl-2'-hydroxy-5'-methylphenyl)-5'-chlorobenzotriazole, 4,4'- butylidene bis (6-t-butyl-m-cresol), 4,4'-cyclohexylidene bis (2-cyclohexyphenol), 4,4'-methylene-bis(2,6-di-t-butyl-phenol), 2,2'-methylene bis (4-methyl-6-t-butylphenol), 2,2'-methylbis[6-(t-methylcyclohexyl)]-P-cresol, 4,4'-thiobis (6-t-butyl-m-cresol), tris (2-methly-4-hydroxy-5-t-butylphenyl)butane, 4-hydroxymethyl-2,6-di-t-butylphenol, etc.

In general, the foregoing antioxidants used in the present invention are added in an amount of 0.01–0.5% by weight, based on the amount of the resin, and preferably 0.05–0.3% by weight. If the amount is less than 0.01% by weight, the initial excellent adhesive strength cannot be maintained for a long period of time, and the adhesive strength is reduced with a lapse of time, especially in a high temperature environment. If the amount of the antioxidant is above 0.5% by weight, when the resin is formed into a film and the film is adhered by fusion to the metallic foil sheet made closure, the antioxidant is deposited to the boundary surface or to an outer surface, which is not desirable.

According to the present invention, the foregoing resin compound is used as the adhesive agent layer and thereby the pull-opening member is adhered to the metallic foil sheet made closure. It will be understood from the foregoing explanation that such a constructional one as described above is not reduced with a lapse of time in its adhesive strength between the metallic foil sheet made closure and the pull-opening member, even if the container is maintained for a long period of time in a high temperature environmental condition. Thus the foregoing resin compound is very practicable.

Figure 4:
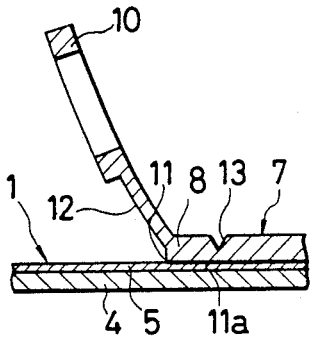
FIGS. 4 and 5 are sectional views showing the opening operation of the first embodiment.
Figure 5:
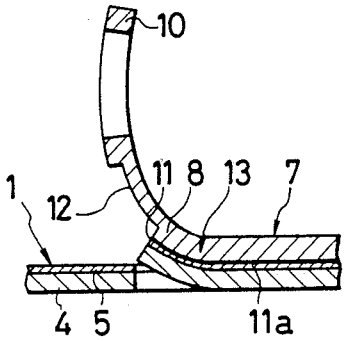

The operation of the opening of the container will be explained as follows:

When the pulling tab 10, as shown in FIG. 4, is held by the fingers and pulled upward, the pulling tab 10 is bent at the thin portion 12 and raised almost to a vertical position. Thus, the force for lifting the pulling tab 10 is applied to the closure 1 as a large shearing force acting thereon and normal thereto. If the pulling tab 10 is further pulled upwards, as shown in FIG. 5, the initial end 11 of the fixing portion is lifted by a lever action having its fulcrum at the weakened portion 13 which results in a breaking of the closure member 1 and thus an initial stage tearing opening of the closure member 1, which can be easily generated.

In this case, due to the existence of the weakened portion 13, such a resistance force that is generated at the initial end portion 8 of the pull-opening member 7 for lifting the whole of the pull-opening member 7 is limited to be within the range between the initial end 11 and the weakened portion 13. This resistance force becomes a shearing resistance force, so that the initial shearing can be carried out by a small force. Namely, when the pulling tab is pulled upwards, a lifting force for lifting the closure 1 is created at the initial end 11 of the fixing portion, and there is generated a shearing force between the lifting force and a resistance force for keeping the closure in its flat condition. In this case, since the pull-opening member 7 is provided with the weakened portion 13, the pull-opening member 7 is less rigid at the weakened portion 13, so that the lifting force is not transmitted to the entire pull-opening member 7, and the lifting force becomes a large shearing force because it is bent about the weakened portion 13, and thereby can easily generate the initial tearing.

In the illustrated example, as shown in FIG. 1, for decreasing the shearing force, the initial end 11 of the fixing portion is formed into an arc for decreasing the width of the initial tearing.

If the adhesive layer 5 between the pull-opening member 7 and the closure 1 becomes deteriorated with a lapse of time, at the time of the initial tearing operation of the closure member 1, the initial end 11 of the fixing portion of the pull-opening member 7 tends to peel off from the top surface of the closure member 1. However, in the foregoing example, when the foregoing resinous compounds are used as the adhesive layer 5, there is no fear of the peeling-off of the end 11, and therefore, the construction of the thin portion 12 and the weakened portion 13 can function effectively.

Next, the subsequent tearing process after the initial tearing will be explained as follows:

If, after the initial tearing is effected a mentioned above, the pulling tab 10 is further pulled upwards, the closure member 1 is given a subsequent tearing starting with a base point X and advancing along the guide edge 15 to reach the opening edge 6 of the ring-shaped member 3, and a tearing starting with the point Y advances along the inside edge 17.

The outside tearing is advanced along the opening edge 6, while the inside tearing is stopped at nearly the middle portion of the inside edge 17 of the pull-opening member 7. The reason for discontinuation of the inside tearing is that, in accordance with the two tearings, there is caused a slackening of the closure 1, at the center region thereof, and the concentration of the tearing stress is dispersed. Accordingly, the tearing stress is concentrated only on the portion extending along the opening edge 6 of the ring-shaped member 3. Thus, only the outside tearing is continued to the last so as to obtain an accurate full opening of the closure member 1.

If the adhesive agent layer 5 between the pull-opening member 7 and the closure member 1 deteriorates over a period of time, the stress for the subsequent tearing is concentrated on the opening edge 6 and the inside edge 17 of the pull-opening member 7, and on this occasion there is generated a peel-off along the inside edge 17. Accordingly, the tearing is advanced beneath the pull-opening member 7, and consequently it often happens that the tearing extending along the inside edge 17 is stopped before going half way around, and thus it becomes difficult to obtain a complete opening. According to the present invention, when the foregoing resin compound is used for the adhesive agent layer 5, there is no problem as mentioned above, and the tearing along the inside edge 17 can be advanced reliably to the necessary one-half of a circle.

Figure 6:
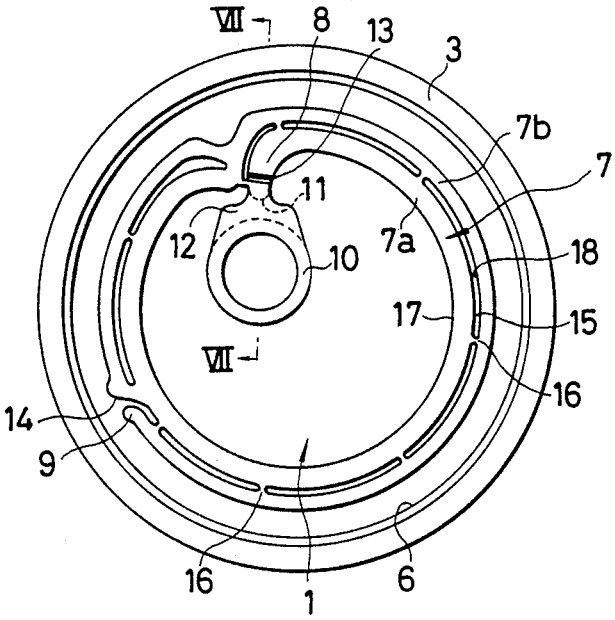
FIG. 6 is a top plan view of another embodiment of the present invention.
Figure 7:
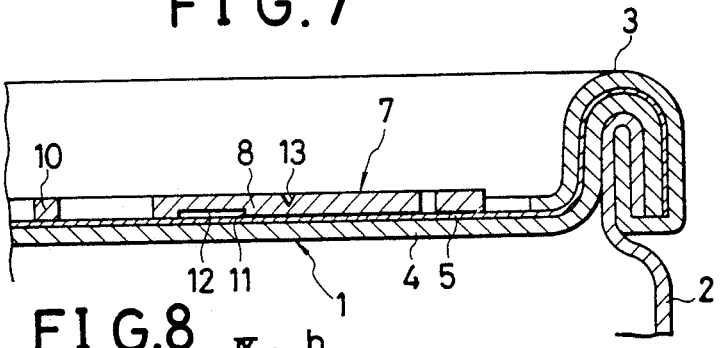
FIG. 7 is a sectional view taken along the line VII—VII of FIG. 6.
Figure 8:
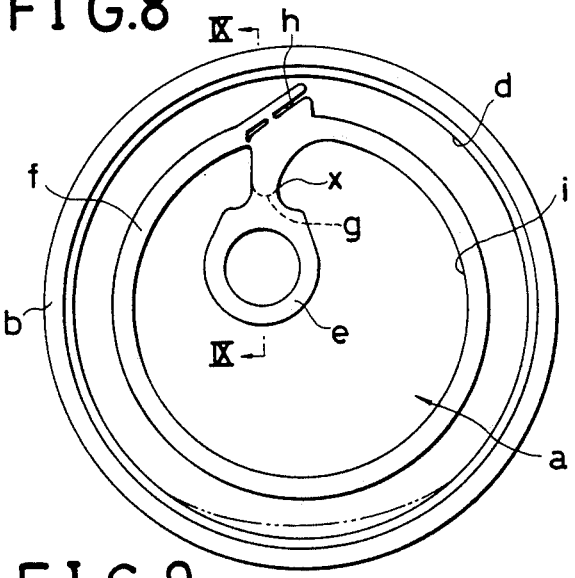
FIG. 8 is a top plan view of a conventional device.
Figure 9:
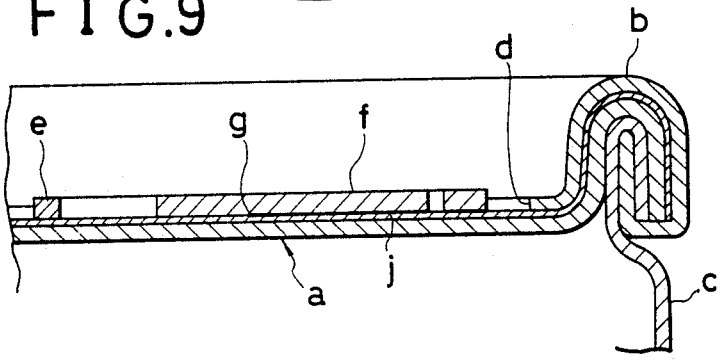
FIG. 9 is a sectional view taken along the line IX—IX of FIG. 8.

FIGS. 6 and 7 show another embodiment of the present invention. This embodiment is substantially equivalent to the foregoing embodiment with the exception that the pull-opening member 7 is different therefrom in shape.

Namely, the pull opening member 7 is composed of a strip-shaped member in almost the same manner as in the foregoing embodiment, but is of such a swirl construction that, in succession to an annular portion *7a* of about one turn extending from the initial end portion 8 having the pulling tab 10, and at a surrounding outside position thereof, there is provided an extended portion *7b* which extends about ¾ turn around the circle, having a final terminal end portion 9.

The two portions *7a, 7b* are spaced apart from one another by a small gap disposed therebetween and are intermittently interconnected with a connecting element 16. Additionally, the outside edge 15 is provided, at a position of about ⅓'s of a turn of portion *7a*, with a guide edge 14 which is directed downwards of the opening edge 6 of the ring-shaped member 3 and which is positioned opposed to the final end portion 9.

Next, the operation for opening this embodiment of the present invention will be explained as follows:

It is not different from the case of the foregoing embodiment that the initial tearing of the closure member 1 is carried out by pulling upwards on the pulling tab 10, by way of the thin portion 12 and the weakened portion 13. If, thereafter, the pulling tab 10 is further pulled upwards and thereby the pull-opening member 7 is lifted up gradually from the initial end portion 8, the tearing advances along the inside edge 18 of the portion *7b* and along the outside edge 15 of the portion *7a*, and the tearing advancing along the inside edge 17 of the portion *7a* is carried out. If the pulling tab 10 is further pulled upwards, the tearing advancing along the inside edge 17 of the portion *7a* is carried out until it reaches about one-half of a circle, and is then stopped because the closure member 1 is slackened with the advance of the tearing of the closure member 1. Accordingly, only the tearing advancing along the outside edge 15 of the portion *7a* is continued, and this tearing is advanced towards the opening edge 6 of the ring-shaped member 3 by the guide edge 14. Thereafter, the region of the closure member 1 that is located between the portion *7b* and the opening edge 6 is kept in its tension state, and the inside edge 18 of the portion *7b* is torn, so that the tearing stress is concentrated only on the portion extending along the opening edge 6. Accordingly, the closure member 1 is torn open reliably along the opening edge 6 by the portion *7b*, and the removal of the entire surface of the enclosure 1 is performed. By forming the pull-opening member 7 into a swirl shape, during the subsequent tearing after the initial tearing, the stress concentrating on the inside edge 17 that is caused, in the case of the pull-opening member of the single circle, as in the foregoing embodiment, can be decreased.

In the foregoing embodiment, the pull-opening member 7 may be of any desired material as long as it can be adhered by the adhesive layer 5 to the closure member 1 and has such a tensile strength that it will not fracture during the tearing operation.

However, when considering the affinity of the pull-opening member 7 for adhesive agent layer 5, it is preferable that the member 7 is made of the same foregoing resins of the same quality as that of the adhesive agent layer 5.

In this case, for preventing any degradation of the pull-opening member 7 itself over a period of time it is preferable that the pull-opening member 7 is made of the foregoing resin compounds. It has been confirmed that, in this case, the object of the present invention can be achieved, even if the adhesive agent layer 5 is made of only the foregoing resins and does not contain the phenol series antioxidant. Thus, although the adhesive layer 5 tends to be degraded by oxidation because it does not contain the phenol series antioxidant, the adhesive layer is covered with the pull-opening member made of the foregoing resin compound, so that any diffusion of oxygen through the pull opening member into the layer will be prevented, and in addition when the pull-opening member is adhered through fusion to the adhesive agent layer, the antioxidant contained in the pull opening member will diffuse into the adhesive agent layer, resulting in an improvement in the degradation, with a lapse of time, of the adhesive layer.

Advantageously, the adhesive layer 5 is also made of the foregoing resin compounds and also contain a phenol series antioxidant.

The following examples are provided as being exemplary of the present invention and thus should not be considered as limiting the scope of the present invention.

EXPERIMENTAL EXAMPLES

As for the carboxyl group containing copolymer resin, there is used ethylene-methacrylic acid copolymer resin NEWCREL 407 (made by Mitsui Du Pont Polychemical, Resin No. 1). As for the ionomer resin, there is used HYMIRAN 1652 (by Mitsui Du Pont Polychemical, Resin No. 2). A phenol series antioxidant is mixed by fusion in each of these resins, whereby there are obtained respective resin compounds with the various contents as shown by adhesive agent Nos. 1–15 in the following Table 1.

Each of these resin compounds is formed into a film of 30μ in thickness by an inflation process, and is applied to an aluminum foil of 60μ in thickness under pressure and heating at a temperature of 200°–240° C. to obtain an aluminum sheet material laminated with the resultant adhesive agent layer.

TABLE 1

| | Construction of container closure | | | | | Tearing opening property of container closure | | | |
|---|---|---|---|---|---|---|---|---|---|
| | | | | | | Immediately after manufacturing | | After kept for 60 days at 50° C. | |
| | | Composition of adhesive agent layer | | | Resin composition | | | | |
| Sample number | Metallic foil | Adhesive agent Number | Used resin | Anti-oxidant (% by weight) | of pull opening member | Initial opening property | Opening property in predetermined shape | Initial opening property | Opening property in predetermined shape |
| 1 | Aluminum foil (60 micron) | 1 | Resin No. 1 | 0 | Same as adhesive agent number 1 | O | O | X | X |
| 2 | Aluminum foil (60 micron) | 2 | Resin No. 1 | IRGANOX 1010 0.005 % | Same as adhesive agent number 2 | O | O | Δ | Δ |
| 3 | Aluminum foil (60 micron) | 3 | Resin No. 1 | IRGANOX 1010 0.01 % | Same as adhesive agent number 3 | O | O | O | O |
| 4 | Aluminum foil (60 micron) | 4 | Resin No. 1 | IRGANOX 1010 0.10 % | Same as adhesive agent number 4 | O | O | O | O |
| 5 | Aluminum foil (60 micron) | 5 | Resin No. 1 | IRGANOX 1010 0.20 % | Same as adhesive agent number 5 | O | O | O | O |

TABLE 1-continued

| Sample number | Construction of container closure: Metallic foil | Composition of adhesive agent layer: Adhesive agent Number | Used resin | Anti-oxidant (% by weight) | Resin composition of pull opening member | Tearing opening property of container closure: Immediately after manufacturing: Initial opening property | Opening property in pre-determined shape | After kept for 60 days at 50° C.: Initial opening property | Opening property in pre-determined shape |
|---|---|---|---|---|---|---|---|---|---|
| 6 | Aluminum foil (60 micron) | 6 | Resin No. 1 | IRGANOX 1010 0.30 % | Same as adhesive agent number 6 | O | O | O | O |
| 7 | Aluminum foil (60 micron) | 7 | Resin No. 1 | IRGANOX 1010 0.50 % | Same as adhesive agent number 7 | O | O | O | O |
| 8 | Aluminum foil (60 micron) | 8 | Resin No. 1 | IRGANOX 1076 0.20 % | Same as adhesive agent number 8 | O | O | O | O |
| 9 | Aluminum foil (60 micron) | 1 | Resin No. 1 | 0 | Same as adhesive agent number 5 | O | O | O | O |
| 10 | Aluminum foil (60 micron) | 1 | Resin No. 1 | 0 | Same as adhesive agent number 2 | O | O | Δ | Δ |
| 11 | Aluminum foil (60 micron) | 9 | Resin No. 2 | 0 | Same as adhesive agent number 9 | O | O | X | X |
| 12 | Aluminum foil (60 micron) | 10 | Resin No. 2 | IRGANOX 1010 0.005 % | Same as adhesive agent number 10 | O | O | Δ | Δ |
| 13 | Aluminum foil (60 micron) | 11 | Resin No. 2 | IRGANOX 1010 0.01 % | Same as adhesive agent number 11 | O | O | O | O |
| 14 | Aluminum foil (60 micron) | 12 | Resin No. 2 | IRGANOX 1010 0.10 % | Same as adhesive agent number 12 | O | O | O | O |
| 15 | Aluminum foil (60 micron) | 13 | Resin No. 2 | IRGANOX 1010 0.30 % | Same as adhesive agent number 13 | O | O | O | O |
| 16 | Aluminum foil (60 micron) | 14 | Resin No. 2 | IRGANOX 1010 0.50 % | Same as adhesive agent number 14 | O | O | O | O |
| 17 | Aluminum foil (60 micron) | 15 | Resin No. 2 | IRGANOX 245 0.30 % | Same as adhesive agent number 15 | O | O | O | O |
| 18 | Aluminum foil (60 micron) | 9 | Resin No. 2 | 0 | Same as adhesive agent number 13 | O | O | O | O |
| 19 | Aluminum foil (60 micron) | 9 | Resin No. 2 | 0 | Same as adhesive agent number 10 | O | O | Δ | Δ |

Evaluation of breaking openability of cans:
Δ represents that out of 100 cans, 10 or less defective cans were generated in the initial tearing opening and the subsequent tearing.
X represents that the tearing opening was impossible concerning all/most of the cans, because of occurrence in peeling-off of the pull-opening members.
O represents that the initial tearing opening and the subsequent tearing were good, resulting in no generation of any defective cans.

The aluminum sheet material is adhered by fusion to a ring-shaped member made of a tin plate through the adhesive layer to obtain a closure member.

In addition, by using a resin compound which is the same as the foregoing adhesive agent, it is formed, by an injection molding, into a pull-opening member of the shape as shown in FIG. 6. A part of the pulling tab thereof is 0.6 mm in thickness, and a V-shaped notch type concave portion of 0.5 mm in depth is made therein near the pulling tab thereof, and the remaining part thereof is 1 mm in thickness.

The resultant pull-opening member is adhered by fusion, except for the pulling tab thereof, to a top surface of the adhesive layer of the foregoing closure member, whereby a container closure is produced.

The same container closure is fixed air-tight, by seaming, to a tin plate made container barrel. In this way, there are produced respective sample containers as shown in Table 1.

Then, for each of these sample containers, 100 cans thereof are prepared, and assuming the case of there being stored in a high temperature environment in the summer, they are kept for 60 days at 50° C. as a test condition. Thereafter the tear opening property thereof by the pull-opening member is examined.

The results thereof are shown in Table 1. It has been found that each of the sample nos. 3–9, 13–18, which are examples embodying the present invention, has an excellent adhesive strength even after a lapse of time, and is good in its initial opening property (an opening property caused by the initial tearing at the fixing portion of the pull-opening member at the time of lifting the pulling tab) and in its predetermined shape opening property (an opening property for being torn into a predetermined shape defined by the opening edge of the ring-shaped member).

Especially the samples nos. 9 and 18 are good, as mentioned before, though each of these represents the embodiment where the antioxidant is not present in the adhesive layer, and a predetermined amount thereof is only present in the pull-opening member.

In contrast therewith, in such a case where the antioxidant is not present in the adhesive layer or the pull-opening member as in the samples nos. 1 and 11, it frequently happens that at the time of the initial opening, the initial end of the fixing portion of the pull-opening member peels off, and the initial tearing becomes difficult. In addition, the pull-opening member peels off when it is lifted.

In the case where the antioxidant of below the predetermined amount is contained in both the adhesive layer and the pull-opening member, as in samples nos. 2 and 12, it is found that a slight peel-off is generated at the initial end of the fixing portion of the pull-opening member at the time of the initial opening operation. The initial tearing is not difficult, but a large lifting force is required, so that when the tearing is advanced along the opening edge of the ring-shaped member, after the initial tearing, there is caused a peel-off at the inside of the pull-opening member, and consequently, the tearing along the inside edge is stopped before reaching the one-half of a circle, and when the whole circumference of the closure is carried out by tearing along the opening edge of the ring-shaped member, there remains an unremoved piece of the closure member at the opening edge.

Samples nos. 10 and 19 are such that the adhesive layer does not contain the antioxidant, and the antioxidant, below the predetermined amount is contained only in the pull-opening member. In this case, almost the same poor results as in the case of the sample nos. 2 and 12 is obtained, and such poor results frequently occur.

Thus, according to the first aspect of the present invention, the adhesive layer for adhering the pull-opening member to the metallic foil made closure member is made of a resin compound containing a phenol series antioxidant in an amount of 0.01–0.5% by weight. The resin is a copolymer resin of an olefin and an $\alpha,\beta$ unsaturated carboxylic acid or ionomer resin. A container is thus obtained with an easy open type closure member such that, even after the container is kept for a long time in a high temperature environment, when the closure member is torn upon along the opening edge of the ring-shaped member by pulling upwards on the pull-opening member, there is not produced any peel-off of the initial end of the fixing portion of the pull-opening member or any peel-off of the inside edge of the pull-opening member, and thereby the closure member can be torn open along the opening edge of the ring-shaped member in a reliable manner without any portion of the closure member remaining unremoved.

According to the second aspect of the present invention, the copolymer resin of an olefin and an $\alpha,\beta$ unsaturated carboxylic acid or ionomer resin is used as the adhesive layer, and such a resin compound containing a phenol series antioxidant in an amount of 0.01–0.5% by weight is used for the pull-opening member, and the pull opening and the adhesive agent layer are adhered together by fusion, so that there can be obtained such a container with an easy open type closure member that, even after being kept for a long period of time in a high temperature environment, the closure member can be torn open along the opening edge of the ring shaped member reliably, without any portion of the closure member remaining unremoved.

What is claimed is:

1. A container with an easy open-type closure comprising:

a closure member made of at least a metallic foil sheet for being affixed together with a ring-shaped member on an opening end portion of a container barrel and a strip-shaped pull-opening member fixed through an adhesive agent layer to a top surface of said closure, said pull-opening member being fixed to said top surface of said closure more firmly than the tearing strength of said closure, and said pull-opening member having a pulling tab, having an outside guide edge directed towards an opening edge of said ring-shaped member, and extending as long as at least one-half of a circle of said opening edge of said ring-shaped member, wherein said adhesive agent layer comprises a resinous compound selected from the group consisting of (1) a copolymer resin of an olefin and an $\alpha,\beta$-unsaturated carboxylic acid containing from 0.01 to 0.5% by weight of a phenol series antioxidant and (2) an ionomer resin containing from 0.01 to 0.5% by weight of a phenol series antioxidant.

2. The container of claim 1, wherein the pull-opening member is formed into an annular shape and is provided with an initial end portion which faces a final end portion thereof, and wherein the guide edge directed towards the opening edge of the ring-shaped member is formed on the outside of the initial end portion.

3. The container of claim 2, wherein a thin portion is provided between the pulling tab and the initial end portion for allowing said pulling tab to bend easily in an upward direction.

4. The container of claim 1, wherein the pull-opening member is formed into a double inner and outer swirl type structure, and an inside end portion of said pull-opening member is formed into the initial end portion of said pull-opening member, said initial end portion being provided with the pulling tab.

5. The container of claim 4, wherein at an intermediate portion adjacent to the final end portion of the pull-opening member a guide edge is provided, said guide edge being directed towards the opening edge of the ring-shaped member.

6. The container of claim 1, wherein the copolymer is ethylene-methacrylic acid.

7. The container of claim 6, wherein the carboxyl group in the copolymer is present in an amount of $0.4\times10^{-3}$ to $3.6\times10^{-3}$ equivalent/gram.

8. The container of claim 7, wherein the carboxyl group in the copolymer is present in an amount of $0.5\times10^{-3}$ to $2.9\times10^{-3}$ equivalent/gram.

9. The container of claim 1, wherein the ionomer resin is an ethylene-methacrylic acid copolymer having a part of the side chain carboxyl group of said copolymer neutralized with a metal.

10. The container of claim 9, wherein the metal is selected from the group consisting of zinc and sodium.

11. The container of claim 9, wherein less than 70% of the side chain carboxyl groups are neutralized with the metal.

12. The container of claim 1, wherein the olefin is selected from the group consisting of ethylene, propylene, and butene, wherein the $\alpha,\beta$-unsaturated carboxylic acid is selected from the group consisting of acrylic acid and methacrylic acid, and wherein the ionomer resin is prepared by neutralizing a part of the side chain carboxyl groups of the copolymer resin with a metal.

13. The container of claim 12, wherein the metal is selected from the group consisting of sodium, potassium, zinc, magnesium, and calcium.

14. The container of claim 1, wherein the resinous compound is mixed with an olefin selected from the group consisting of polyolefins, polyethylene, polypropylene, olefin polymers without carboxyl groups, and an ethylene-vinyl acetate copolymer.

15. The container of claim 1, wherein the copolymer resin and the ionomer resin contain from 0.01 to 0.3% by weight of a phenol series antioxidant.

16. The container of claim 1, wherein a weakened portion is provided adjacent to the initial end portion for weakening the rigidity of the pulling-open member.

17. A container with an easy open-type closure comprising:

a closure member made of at least a metallic foil sheet for being affixed together with a ring-shaped member on an opening end portion of a container barrel and a strip-shaped pull-opening member fixed through an adhesive agent layer to a top surface of said closure, said pull-opening member being fixed to said top surface of said closure more firmly than the tearing strength of said closure, and said pull-opening member having a pulling tab, having an outside guide edge directed towards an opening edge of said ring-shaped member, and extending as long as at least one-half of a circle of said ring-shaped member, wherein said adhesive agent layer and said pull-opening member comprise a resinous compound selected from the group consisting of (1) a copolymer resin of an olefin and an $\alpha,\beta$-unsaturated carboxylic acid and (2) an ionomer resin, and wherein the resin of said pull-opening member contains from 0.01 to 0.5% by weight of a phenol series antioxidant, and wherein said pull-opening member and said adhesive agent layer are adhered together by fusion.

18. The container of claim 17, wherein the pull-opening member is formed into an annular shape and is provided with an initial end portion which faces a final end portion thereof, and wherein the guide edge directed towards the opening edge of the ring-shaped member is formed on the outside of the initial end portion.

19. The container of claim 18, wherein a thin portion is provided between the pulling tab and the initial end portion for allowing said pulling tab to bend easily in an upward direction.

20. The container of claim 18, wherein a weakened portion is provided adjacent to the initial end portion for weakening the rigidity of the pulling-open member.

21. The container of claim 17, wherein the pull-opening member is formed into a double inner and outer swirl type structure, and an inside end portion of said pull-opening member is formed into the initial end portion of said pull-opening member, said initial end portion being provided with the pulling tab.

22. The container of claim 17, wherein the adhesive agent layer contains from 0.01 to 0.5% by weight of a phenol series antioxidant.

23. The container of claim 17, wherein the copolymer is ethylene-methacrylic acid.

24. The container of claim 17, wherein the ionomer resin is an ethylene-methacrylic acid copolymer having a part of the side chain carboxyl group of said copolymer neutralized with a metal.

25. The container of claim 17, wherein the olefin is selected from the group consisting of ethylene, propylene, and butene, wherein the $\alpha,\beta$-unsaturated carboxylic acid is selected from the group consisting of acrylic acid and methacrylic acid, and wherein the ionomer resin is prepared by neutralizing a part of the side chain carboxyl groups of the copolymer resin with a metal.

26. The container of claim 25, wherein the metal is selected from the group consisting of sodium, potassium, zinc, magnesium, and calcium.

27. The container of claim 17, wherein the resinous compound is mixed with an olefin selected from the group consisting of polyolefins, polyethylene, polypropylene, olefin polymers without carboxyl groups, and an ethylene-vinyl acetate copolymer.

28. The container of claim 17, wherein the copolymer resin and the ionomer resin contain from 0.01 to 0.3% by weight of a phenol series antioxidant.

* * * * *

UNITED STATES PATENT AND TRADEMARK OFFICE

CERTIFICATE OF CORRECTION

PATENT NO. : 4,966,301

DATED : October 30, 1990

INVENTOR(S) : Yuji Yamashita; Koji Kobayashi; Keisuke Shimizu; and Koji Maekawa

It is certified that error appears in the above-identified patent and that said Letters Patent is hereby corrected as shown below:

Column 17, line 12 (i.e. line 2 of Claim 16), the term "claim 1" should read --claim 2--.

Signed and Sealed this

Nineteenth Day of May, 1992

*Attest:*

*Attesting Officer*

DOUGLAS B. COMER

*Acting Commissioner of Patents and Trademarks*